US009566461B2

(12) United States Patent
Avila

(10) Patent No.: US 9,566,461 B2
(45) Date of Patent: Feb. 14, 2017

(54) CORROSION RESISTANT NOZZLE

(71) Applicant: Tyco Fire Products LP, Lansdale, PA (US)

(72) Inventor: Melissa B. Avila, Millbury, MA (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 14/510,032

(22) Filed: Oct. 8, 2014

(65) Prior Publication Data

US 2015/0021415 A1 Jan. 22, 2015

Related U.S. Application Data

(63) Continuation of application No. PCT/US2014/021886, filed on Mar. 7, 2014.

(60) Provisional application No. 61/774,525, filed on Mar. 7, 2013.

(51) Int. Cl.
*A62C 37/08* (2006.01)
*A62C 35/68* (2006.01)

(52) U.S. Cl.
CPC ..... *A62C 37/08* (2013.01); *A62C 35/68* (2013.01)

(58) Field of Classification Search
CPC ..... A62C 37/08; A62C 35/68; A62C 31/02; A62C 37/09; B23P 11/00
USPC ..... 239/518, 522; 169/37; 137/560, 15.01
See application file for complete search history.

(56) References Cited

U.S. PATENT DOCUMENTS

| | | | | |
|---|---|---|---|---|
| 3,698,483 | A * | 10/1972 | Martin et al. | 169/37 |
| 4,739,835 | A | 4/1988 | Polan et al. | |
| 5,505,383 | A * | 4/1996 | Fischer | 239/518 |
| 5,628,367 | A * | 5/1997 | Truax et al. | 169/37 |
| 5,713,524 | A * | 2/1998 | Greene et al. | 239/596 |
| 5,921,322 | A * | 7/1999 | Bonfield et al. | 169/37 |
| 6,037,061 | A * | 3/2000 | Ohmi | 428/472.1 |
| 6,371,212 | B1 | 4/2002 | Jackson | |
| 6,454,017 | B1 | 9/2002 | Fischer et al. | |
| 6,561,218 | B2 * | 5/2003 | Mudd | 137/487.5 |
| 7,353,882 | B2 | 4/2008 | Pahila | |
| 2008/0308285 | A1 | 12/2008 | Su et al. | |
| 2010/0193203 | A1 | 8/2010 | Reilly et al. | |
| 2011/0272167 | A1 * | 11/2011 | Harrington et al. | 169/37 |
| 2012/0132446 | A2 | 5/2012 | Harrington et al. | |

OTHER PUBLICATIONS

Su et al., Pilot Testing of Fire Sprinkler System in Extremely Corrosive Industrial Duct Environments, Mar. 6, 2013, Wiley Online Library, DOI 10.1002/prs.11575, http://onlinelibrary.wiley.com/doi/10.1002/prs.11575/pdf.*

Dulux Protective Coatings, PC Tech Notes, 1.1.2 Mild Steel Surface Preparation, Sep. 2009, 2 pages.

(Continued)

*Primary Examiner* — Arthur O Hall
*Assistant Examiner* — Chee-Chong Lee
(74) *Attorney, Agent, or Firm* — Perkins Coie LLP

(57) ABSTRACT

A coated corrosion-resistant nozzle with a diffuser configured to support a coating and a coating that, together, inhibit functionally-debilitating corrosion of the nozzle for a desirable period of time within a corrosive environment. The diffuser includes exterior surfaces configured to enhance the corrosion-resistance properties of the coating to extend the duration of the corrosion protection provided to the nozzle by the coating.

19 Claims, 8 Drawing Sheets

(56) References Cited

OTHER PUBLICATIONS

Factory Mutual (FM) Global Technologies LLC, Approval Standard for Automatic and Open Water . . . Systems, Class Number 2021,2025, Feb. 2010, 23 pages.
Paul Su et al., Factory Mutual (FM) Global Technologies LLC, Fire Protection for Extremely Corrosive Industrial Duct Environments, 2007, 13 pp.

* cited by examiner

CORROSION RESISTANT NOZZLE

PRIORITY CLAIM & INCORPORATION BY REFERENCE

This application is a continuation application under 35 U.S.C. §120 of International Application No. PCT/US2014/021886 filed Mar. 7, 2014, which claims the benefit of priority to U.S. Provisional Patent Application No. 61/774,525, filed Mar. 7, 2013, each of which is incorporated by reference in its entirety.

TECHNICAL FIELD

This invention relates generally to fire protection systems with components exposed to corrosive environments. More specifically, the invention is directed to nozzles for fire protection systems exposed to a corrosive environment within a duct system.

BACKGROUND OF THE INVENTION

One known problem with an industrial facilities is the corrosion of metals in pipes, valves and other parts of the ductwork. The environment inside these ductwork systems can be extremely corrosive and could include high concentrations of inorganic acids, such as hydrochloric, nitric and sulfuric acids. Also, factors such as high temperatures and abrasive particles passing through the ducts can lead to corrosion metal components. Corrosion can cause operational reliability issues as well as performance reliability issues for fire protection components. Examples of damage that could be caused by corrosion may include plugged piping, clogging of control valves or simply non-operable sprinklers and nozzles. Metallic fire components, such as, sprinklers or nozzles located within the ductwork are at risk and may be easily damaged or corroded.

Various corrosion resistant sprinklers and nozzles have been proposed in an attempt to try to withstand these extremely-corrosive environments. For example, U.S. Patent Publication No. 2008/0308285, entitled "Corrosion Resistant Sprinklers, Nozzles, and Related Fire Protection Components and Systems" and U.S. Patent Publication No. 2011/0272167, entitled "Combined Plug and Sealing Ring for Sprinkler Nozzle and Related Methods," each of which is incorporated by reference in their entireties, disclose sprinklers and nozzle configurations, in additions to, coatings believed to be appropriate for maintaining the integrity of a sprinkler or nozzle in such extremely corrosive environments. However, the inventor has discovered that the geometry of the nozzles and sprinklers disclosed in each of the patent publications is insufficient to actually maintain a corrosion resistant coating in a corrosive environment and provide an appropriate spray pattern for addressing a fire inside ductwork containing the corrosive environment.

SUMMARY OF THE INVENTION

The present invention provides a corrosion-resistant nozzle for a fire protection system installed in a corrosive environment, such as within a duct system conveying a corrosive fluid. A preferred embodiment of the nozzle includes a diffuser that is supported by the nozzle to receive and disperse a flow of fire-fighting fluid, with the diffuser and the nozzle as a whole configured to support a protective coating disposed over the external surfaces of the nozzle.

The protective coating and the nozzle surfaces supporting the coating inhibit functionally-debilitating corrosion of the nozzle for a desirable period of time within a corrosive environment. The exterior surfaces of the diffuser are configured to enhance the corrosion-resistance properties of the coating to extend the duration of the corrosion protection provided to the nozzle by the coating.

The present invention also provides a method of protecting a duct from a fire by aligning a coated nozzle so that it covers an excluded area underneath another nozzle. The present invention also provides a duct fire protection system with adjacent coated nozzles disposed in a duct to cover the mutual excluded areas of each adjacent nozzle. Also provided is a method of testing a corrosion resistant nozzle having a coated diffuser with a splitter and an imperforated deflector.

In a preferred embodiment, the nozzles includes a diffuser that has a splitter and an imperforated deflector having rounded edges on exterior-facing surfaces. The preferred diffuser supports the coating with a splitter having an outer diameter that is one third to two thirds of the outer diameter of the deflector. In another embodiment, the diffuser has a splitter and deflector with portions that together define an imperforated impact surface positioned to receive and disperse a flow of the fire-fighting fluid, with the splitter providing a transition surface disposed at an angle of 130-145 degrees relative to the deflector and having a rounded or chamfered edge at all of the exterior corners that define the impact surface. In preferred embodiments, the nozzle is coated with a polymer such as ethylene-chlorotrifluoroethylene.

In a further preferred embodiment a nozzle for delivering a fire-fighting fluid to a corrosive environment as described herein is provided and includes a nozzle body defining a central axis and an exit port. The nozzle includes a support member extending from the nozzle body to support a diffuser to face the exit port, with the diffuser having a splitter portion and a deflector portion that together define an imperforated impact surface disposed to receive the fire-fighting fluid exiting the exit port. The splitter portion of the diffuser preferably has a first end with an apex facing the exit port and an opposing second end with a base defining an outer diameter of the splitter. In some preferred embodiments, the nozzle includes a deflector having a central portion disposed orthogonally to the central axis and surrounded by a peripheral portion disposed at an angle relative to the central portion. The peripheral portion has a peripheral edge defining an outer diameter of the deflector, with the impact surface extending from the apex to the peripheral edge. A coating is disposed to cover at least the nozzle body, the support member, and the diffuser to inhibit functionally-debilitating corrosion of the coated impact surface and maintain the impact surface in a serviceable condition when the nozzle is exposed to the corrosive environment for a period of protection. The outer diameter of the splitter is preferably one third to two thirds of the deflector outer diameter, and the deflector peripheral edge is rounded in a direction generally parallel to the central axis, the rounded peripheral edge has a radius of at least 1 mm to approximately 2 mm and the outer diameter of the splitter is approximately 50% of the deflector outer diameter. In some preferred embodiments, the splitter defines a splitter height between the first end with the apex and the second end with the base, with the splitter height being 0.43 to 1 times the splitter base outer diameter and, more preferably, approximately 0.67 times the splitter base outer diameter. In some preferred embodiments, the angle of the deflector peripheral portion is approximately 10-20 degrees. The splitter defines a cone angle of the splitter extending from the apex towards the base, with the cone angle being 60-70 degrees and, more preferably, approximately 64 degrees.

In some preferred embodiments, the splitter comprises a transition surface extending between the apex and the splitter base, with the transition surface and the deflector defining an internal angle between the splitter and the deflector, and with the internal angle being 130-145 degrees and, more preferably, approximately 137 degrees. The apex is preferably rounded in a direction generally orthogonal to the central axis, and the rounded apex has a peripheral edge with a radius of at least 1 mm to approximately 2 mm. The impact surface preferably defines a dispersal pattern of the fire-fighting fluid when the fluid is distributed about the nozzle central axis, with the dispersal pattern defining a distribution angle of 120-160 degrees and, more preferably, approximately 140 degrees. In some preferred embodiments, the corrosive environment is within a duct system, with the nozzle being disposed to deliver the fire-fighting fluid to an interior of the duct system when the nozzle is activated. The nozzle is preferably activated by the delivery of the fire-fighting fluid from a fire protection system coupled to the nozzle, with the fire protection system having a valve that the controls the delivery of the fluid to the nozzle and a control system controlling an operation of the valve. In preferred embodiments, the coating comprises at least one of polytetrafluoroethylene (PTFE), ethylene-chlorotrifluoroethylene (ECTFE), ethylene-tetrafluoroethylene (ETFE), polyvinylidene fluoride (PVDF), perfluoralkoxy (PFA), and fluorinated ethylene propylene (FEP).

In yet another embodiment, a method of protecting a duct from fire is provided. The method includes aligning a first coated nozzle to deliver a dispersal pattern of a fire-fighting fluid to the interior of the duct, with the dispersal pattern having a distribution angle of 120-160 degrees and an excluded area centrally located within the distribution angle that is substantially omitted from a direct flow of the fire-fighting fluid from the nozzle. The methods also aligns a second coated nozzle proximate to the first coated nozzle so as to deliver a direct flow of the second coated nozzle of the fire-fighting fluid to the excluded area of the first coated nozzle.

In still yet another embodiment, a duct fire protection system is provided as described herein. The system provides a fluid-supply line providing a fire-fighting fluid to the fire protection system having a first coated nozzle providing a dispersal pattern with a distribution angle of 120-160 degrees and defining an excluded area that is protected by a second coated nozzle proximate to the first coated nozzle.

In yet another embodiment, a method of testing a corrosion resistant nozzle is provided. The method includes disposing the nozzle in a corrosive environment for a period of time, with the nozzle having a coated diffuser with a splitter and an imperforated deflector. The method also includes evaluating the nozzle after the period of time for an indication of corrosion.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the exemplary embodiments of the invention.

DETAILED DESCRIPTION

Figure 1:
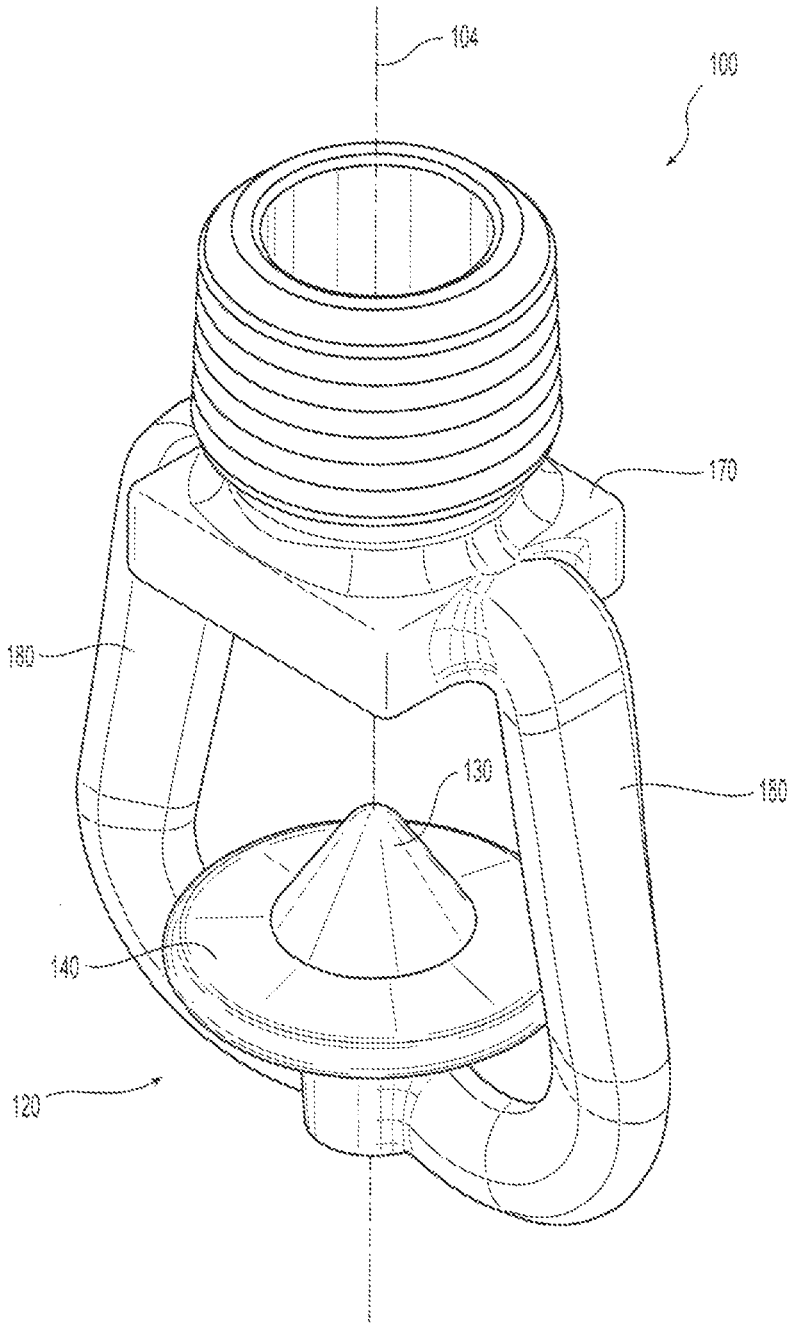
FIG. 1 is an isometric view of the preferred coated nozzle.
Figure 2:
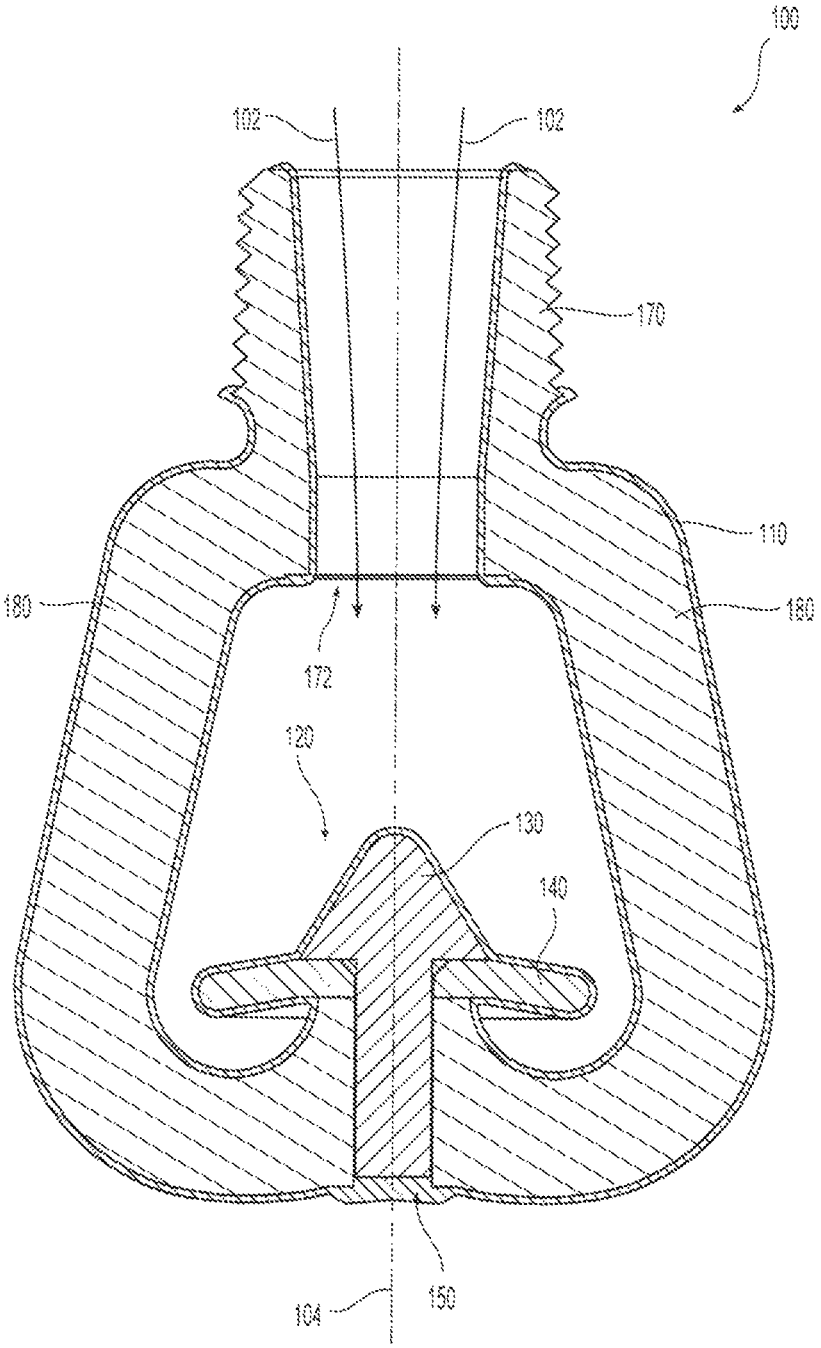
FIG. 2 is a cross-sectional view of the coated nozzle of FIG. 1 taken along a bisecting plane.

Referring to FIGS. 1 and 2, a preferred embodiment of a corrosion-resistant nozzle 100 is provided with a diffuser 120 that is configured to support a protective coating 110 and, together, the diffuser 120 and coating 110 inhibit functionally-debilitating corrosion of the nozzle 100 for a desirable period of time within a corrosive environment. The diffuser 120 includes exterior surfaces configured to enhance the corrosion-resistance properties of the coating 110 to extend the duration of the corrosion protection provided to the nozzle 100 by the coating 110. The diffuser 120 is also configured to control the placement and dimensions of the coating 110 to enhance the protection of portions of the nozzle 100 that are prone to corrosion for a desirable period of time in a corrosive environment. The exterior surfaces of the diffuser 120 also provide surface features, described below, that control the flow of a fire-fighting fluid 102 delivered by the nozzle 100 when coated with the corrosion-resistant coating 110.

The nozzle 100 includes the diffuser 120, a nozzle body 170 with an exit port 172 for the delivery of the flow of fluid 102 to the diffuser 120 when the nozzle 100 is activated, and a support member 180 that extends from the nozzle body 170 to support the diffuser 120. The diffuser 120 includes a splitter 130 and a deflector 140, and a connection portion 150 that secures the splitter 130 and deflector 140 to the support member 180. Preferably, the splitter 130 and the connection portion 150 are a unitary structure with the connection portion 150 passing through the deflector 140 to engage the support member 180 with, preferably, a press fit or, alternatively, threads or knurling. The exterior surfaces of the diffuser 120 define a dispersal pattern for the fluid 102 when the nozzle 100 is activated. Preferably, the nozzle body 170, the exit port 172, and/or the diffuser 120 define a central axis 104 of the nozzle 100 along which the flow of fluid 102 is delivered to the diffuser 120.

Figure 3:
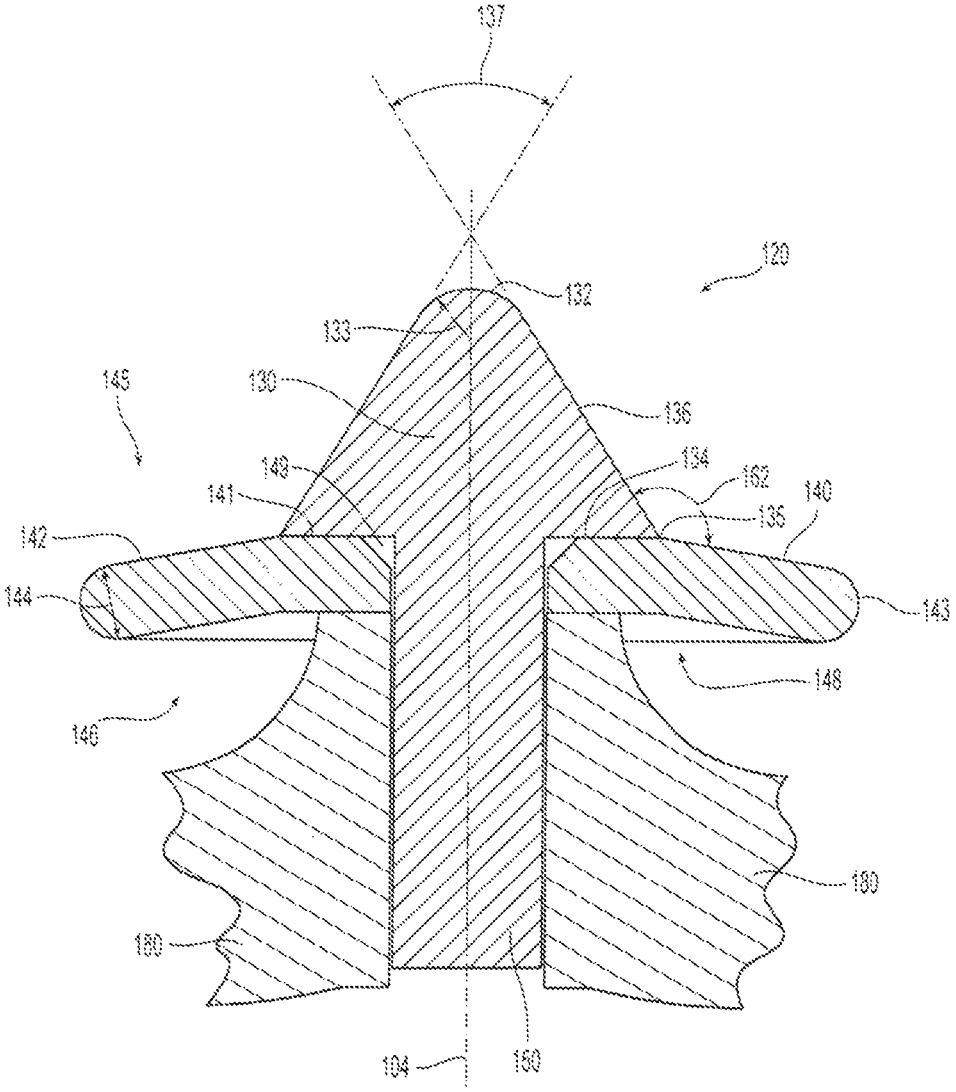
FIG. 3 is an expanded cross-sectional view of an uncoated portion of the nozzle of FIG. 2.

In the preferred uncoated embodiment illustrated in FIG. 3, the uncoated splitter 130 has a cone-like shape with a rounded apex 132 facing the exit port 172 and a base 134 of the cone abutting the deflector 140. More preferably, the splitter 130 has a paraboloid shape with a spheroid apex 132, a circular base 134, and a frusto-conical transition surface 136 extending from the apex 132 at a tangent to meet a periphery 135 of the circular base 134. The apex 132 preferably has an apex radius 133 that is 1-3 mm and, more preferably, has an apex radius of approximately 2 mm. The apex 132 also preferably has a frusto-conical transition surface 136 that defines a cone angle 137 of 60-70 degrees and, more preferably, has a cone angle of approximately 64 degrees. The splitter circular base 134 preferably has a diameter of 10-14 mm and, more preferably, has a diameter of approximately 12 mm. The splitter also has a splitter height extending from the base 134 to the apex 132 along the central axis 104, with a preferable splitter height of 6-10 mm and, more preferably, a splitter height of approximately 8 mm. The splitter height (h) and the splitter circular base 134 diameter (d) together provide a ratio that preferably ranges from 0.43 (h/d=6 mm/14 mm) to 1.0 (h/d=10 mm/10 mm), and more preferably has a ratio of 0.67 (h/d=8 mm/12 mm).

The splitter 130 can also have alternative configurations that provide support for the coating and the formation of the dispersal pattern. For example, the apex radius 133 can be increased to provide a larger apex 132 or decreased to provide a smaller apex, and the cone angle 137 can be decreased to extend the frusto-conical transition surface 136 and project the apex 132 closer to the nozzle body 170 or be increased to flatten out the conical shape of the diffuser 120 and increase the size of the circular base 134. In alternative configurations, the transition surface 136 can be a curved surface in the direction of the central axis to provide a convex or concave shape extending between apex 132 and the base 134, or provide one or more undulations along the central axis or about the central axis. The surface of the apex 132 and the transition surface 136 can be smooth as illustrated in FIG. 3 or these surfaces can have bumps or be faceted with a series of flattened portions that abut each other at slight angles in the direction of the central axis to provide a surface suitable to support the coating. The surface of the apex 132 and the transition surface 136 can also be formed to provide a series of steps in the direction of the central axis.

In the preferred embodiment, the deflector 140 has the shape of a disc with a flat central portion 141 surrounded by a conical peripheral portion 142 that is angled away from the splitter 130 to terminate at a peripheral edge 143 of the deflector. The deflector 140 preferably has opposing disc faces that meet at the peripheral edge 143, which is rounded as viewed from a cross-section of the deflector 140. The opposing disc faces preferably provide a flow-facing side 145 facing the flow of fluid 102 and an external side 146 facing away from the flow of fluid, and the opposing disc faces taken together define a thickness of the deflector. The flat central portion 141 of the deflector 140 preferably has disc faces that are perpendicular to the central axis 104, and the conical peripheral portion 142 of the deflector 140 preferably has disc faces that are angled relative to the disc faces of the flat central portion 141. In the preferred embodiment, a bend 148 of the deflector 140 is disposed between the flat central and conical peripheral portions 141, 142 of the deflector, and the bend 148 defines an outer diameter of the flat central portion 141 that compliments the base 134 of the splitter 130 to allow the flow-facing side 145 of the deflector 140 to abut the base 134 of the splitter when the deflector is assembled with the splitter.

Preferably, the bend 148 disposes the conical peripheral portion 142 at about 70-80 degrees relative to the central axis 104 to define a cone angle of 140-160 degrees about the central axis. The bend 148 also preferably disposes the conical peripheral portion 142 at approximately 10-20 degrees relative to the flat central portion 141. In the preferred deflector 140, the peripheral edge 143 of the deflector where the opposing disc faces of the deflector meet provides a edge curvature that continues from the flow-facing side 145 to the external side 146 (as viewed in a cross-section bisecting the deflector along the central axis), with the edge curvature being a diameter 144 in the cross-section that is equal to the thickness of the deflector 140. Preferably the peripheral edge 143 is configured to provide a continuous curvature (in the cross-section) that joins the front-facing side 145 to the external side 146 about the entire peripheral edge 143 of the deflector. Preferably, the edge curvature has a diameter 144 of 1-3 mm and the deflector has a thickness of 1-3 mm and, more preferably, a diameter 144 of approximately 2 mm and the deflector has a thickness of approximately 2 mm. The deflector also preferably has a central through hole 149 passing through the center of the flat central portion 141 and sized to accept the connection portion 150.

Figure 4:
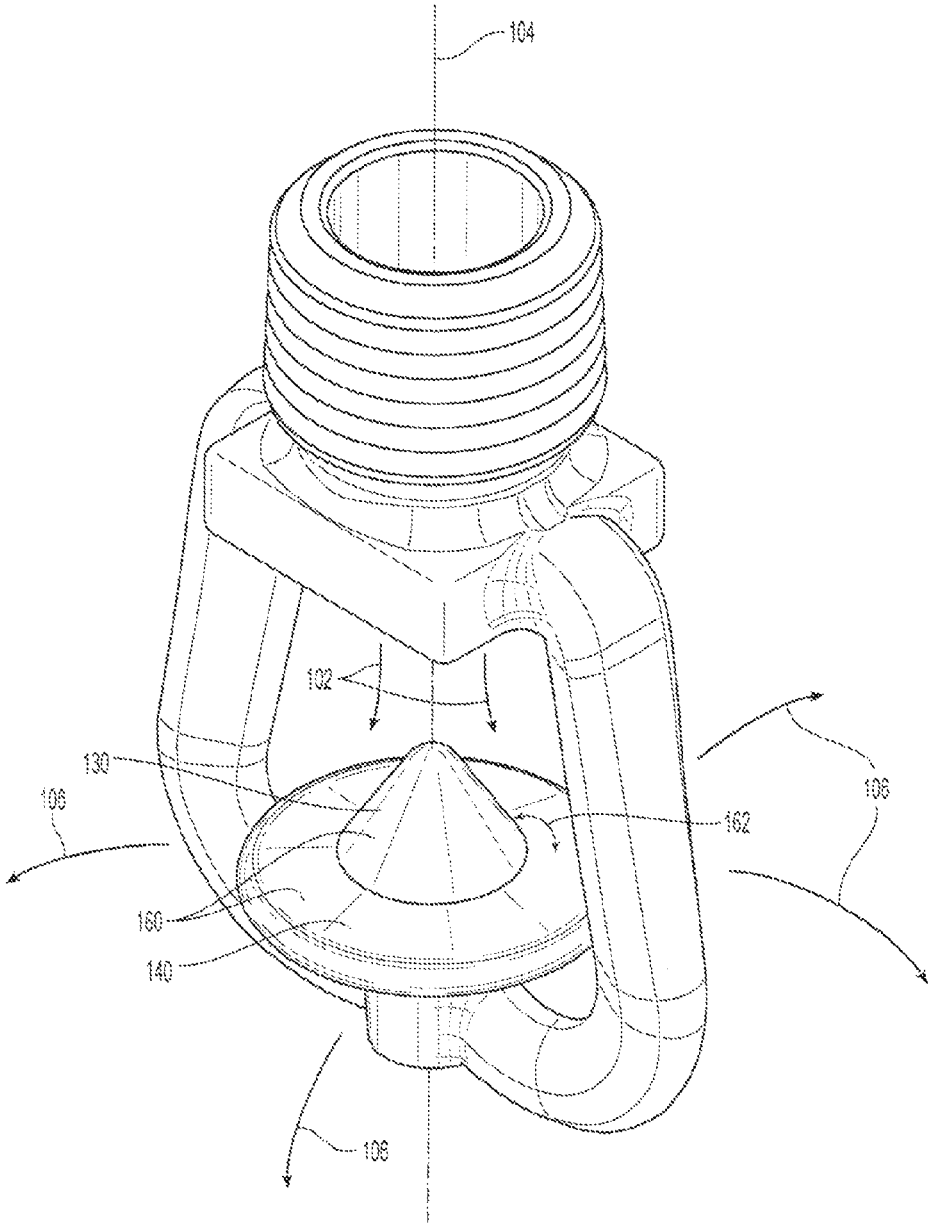
FIG. 4 is an isometric view of the coated nozzle of FIG. 1.
Figure 5:
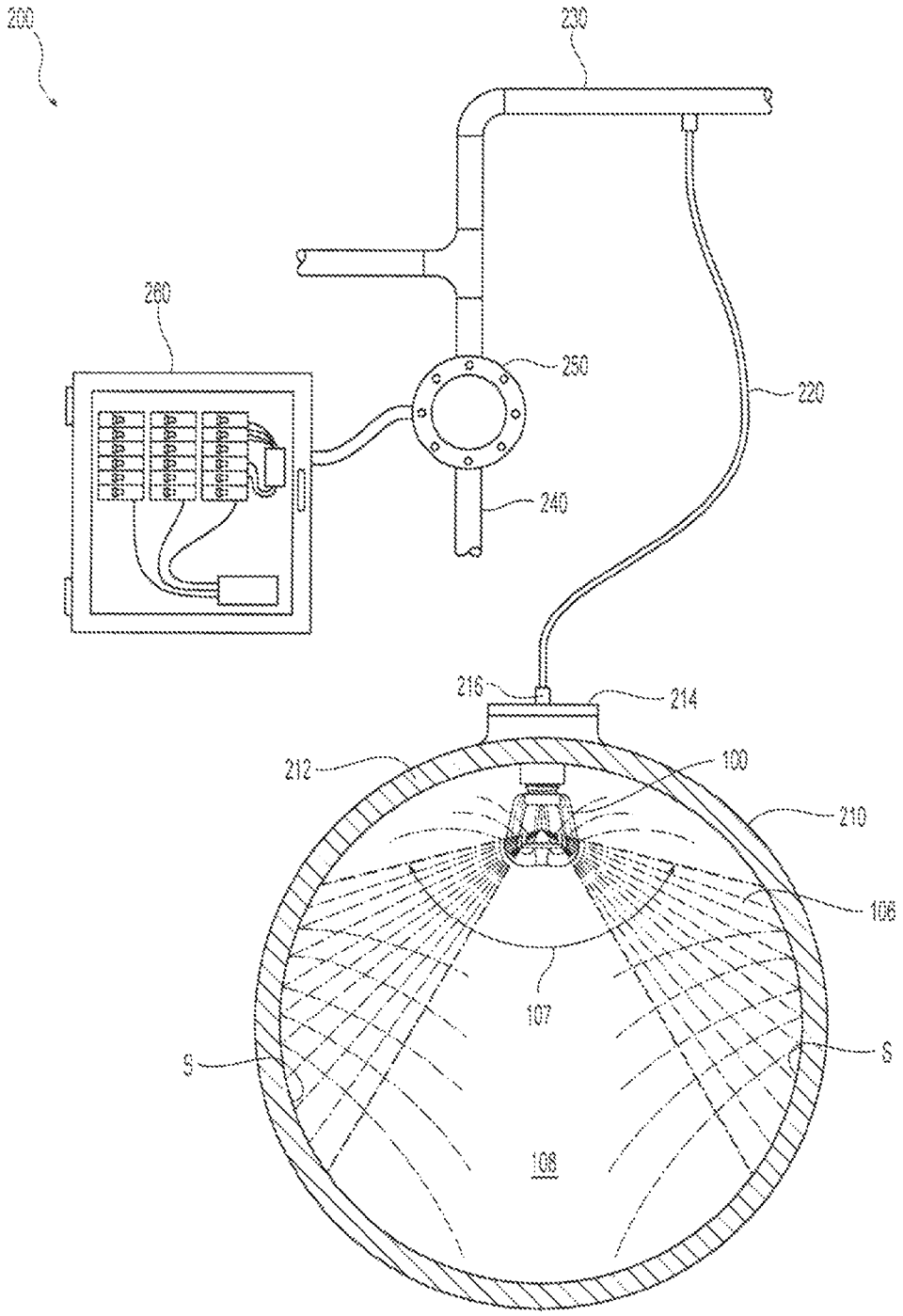
FIG. 5 is a partial cross-sectional plan view of a fire protection system incorporating the nozzle of FIG. 1 within a duct installation.
Figure 6:
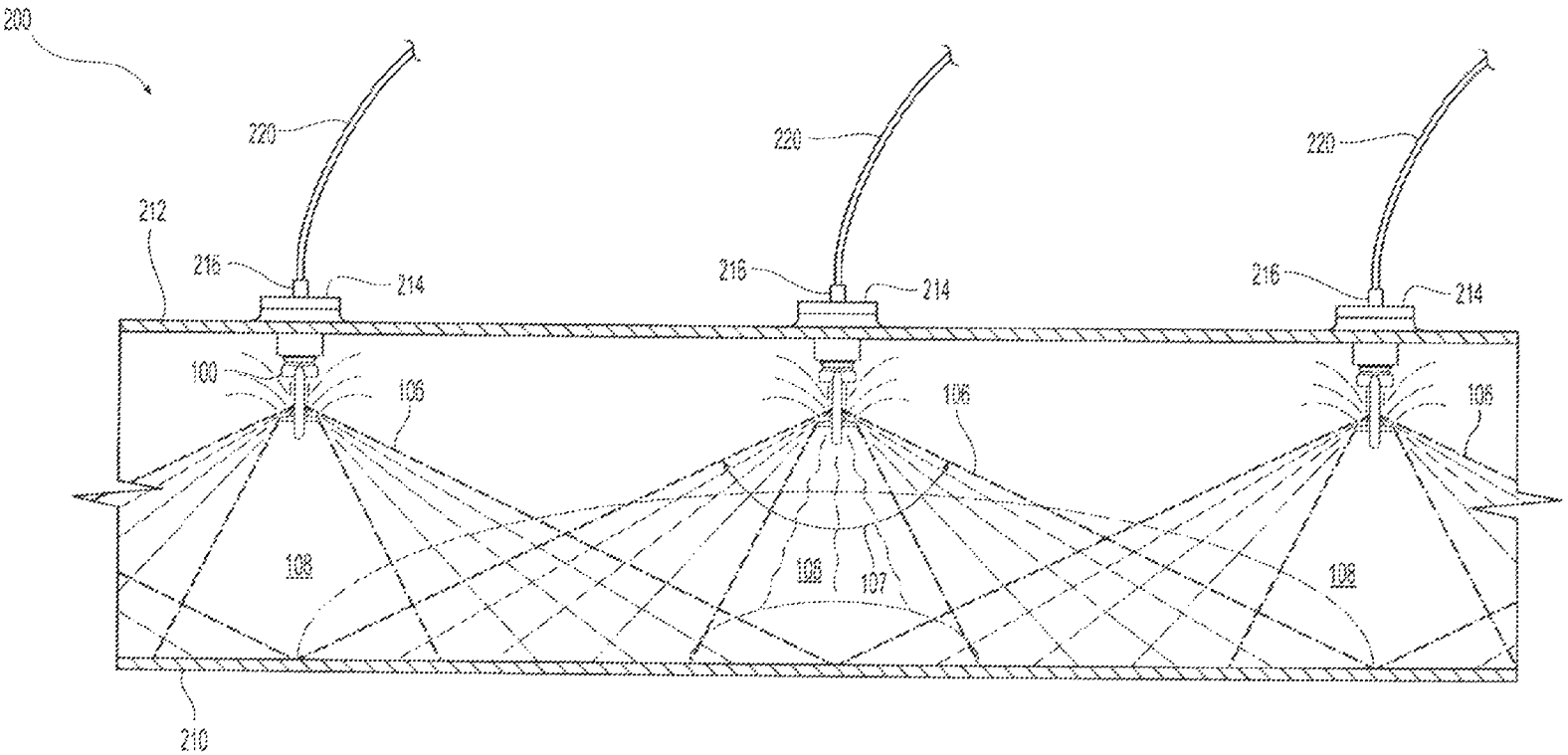
FIG. 6 is a partial cross-sectional plan view of the duct installation of FIG. 5.

In an alternative embodiment, the deflector 140 can have alternative configurations that provide support for the coating 110 and the formation of the dispersal pattern 106 (see FIGS. 4-6). For example, the deflector 140 can provide a flow-facing side 145 that is more flat or that provides a continuous curve from the base 134 of the splitter to the peripheral edge 143 of the deflector. The deflector 140 can have a curved surface that is concave to provide a flow-facing side 145 that extends farther away from the splitter 130 to provide a larger deflector 140 that dominates the form of the dispersal pattern 106, or that is convex to curve more quickly to the peripheral edge 143 to provide a hemispherical or bell-shaped profile to the deflector 140. The bend 148 can be varied to provide a lesser bend that defines a cone angle of the deflector that is greater than 160 degrees about the central axis 104 to provide a flatter deflector 140, or provide a greater bend that defines a deflector cone angle that is less than 140 degrees to provide a more angled cone shape to the deflector. In another embodiment, the flow-facing side 145 can have a surface that undulates, or that provides grooves or channels to direct the flow across the deflector. The deflector 140 can also have a thickness that varies, or have a deflector thickness that is constant for the entire deflector except for the peripheral edge 143 where the thickness increases to provide a rounded edge curvature that appears as a lobe in the cross-section. For example, a lobed peripheral edge can be formed on a deflector with a thickness of 2.4 mm and an edge curvature with a diameter 144 (in the cross-section) that is greater than 2.4 mm. In an opposite fashion, the thickness of the deflector can be increased and the peripheral edge can have two curvatures in the cross-section with an intermediate flat section between them, with the flow facing side 145 leading to a first curvature and then to a flat portion and then to a second curvature that joins the external side 146 of the deflector. Also, the deflector can have a peripheral edge 143 that is a non-circular alternative configuration when viewed from the exit port 172 such as, for example, a generally polygonal shape with appropriately configured corners or, in another example, a shape that approximates a square.

Referring to FIGS. 3 and 4, taken together the flow-facing sides of the splitter 130 and the deflector 140, excluding the portion of the deflector covered by the splitter base 134, can define an impact surface 160 of the diffuser 120 that provides the entire splitter/deflector flow-facing surface upon which the flow of fluid 102 impacts to produce the dispersal pattern 106. The impact surface 160 can be formed of the preferred splitter 130 and preferred deflector 140, with the splitter and deflector coming together to form an internal angle 162 between each other where splitter and deflector portions of the impact surface 160 mate. The impact surface 160 and/or the portions of the splitter 130 and deflector 140 forming the impact surface 160 are preferably imperforated. In the preferred embodiment, the splitter 130 provides a portion of the impact surface 160 with a 32-degree angle to the central axis 104 and the deflector 140 provides a portion of the impact surface at an 75-degree angle to the central axis, thus providing an impact surface with an internal angle 162 of 137 degrees. The internal angle can be varied with variations in the surfaces and angles of the splitter 130 and deflector 140 as described previously so as to provide, for example, an internal angle 162 between 130-145 degrees. In the preferred embodiment illustrated in FIGS. 1-4, the impact surface 160 is in part defined by the outermost diameter of the splitter, located at the periphery 135 of the circular base 134 of the splitter 130, and the outermost diameter of the deflector, located at the peripheral edge 143 of the deflector 140. Preferably, the diffuser has outer diameters of the splitter and deflector that are related to each other to provide a splitter outer diameter that is one third (33%) to two thirds (66%) of the size of the deflector outer diameter. In the preferred embodiment, the splitter outer diameter is 10-15 mm and the deflector outer diameter is 20-30 mm. In a more preferred embodiment, the splitter outer diameter is approximately 12 mm and the deflector outer diameter is approximately 25 mm which provides a splitter outer diameter that is approximately 50% of the deflector outer diameter.

The impact surface 160 and the internal angle 162 can be varied while maintaining support of the overlying coating and providing sufficient corrosion resistance. The impact surface 160 can include one or more steps between the apex 132 of the splitter 130 and the peripheral edge 143 of the deflector 140, with the steps being on a scale that supports the overlying coating and provides a coating thickness that is comparatively smoother than the steps and sufficient to provide corrosion resistance. In another alternative, the deflector 140 can also have a shape that mates with the splitter base 134 at a tangent to provide the appearance of an uninterrupted surface that extends from the splitter 130 to the deflector 140 without a clearly defined internal angle 162.

Referring to FIGS. 4-6, the dispersal pattern 106 is preferably formed as a spray produced when the fire-fighting fluid 102 engages the impact surface 160 of the diffuser 120. The spray preferably forms a dispersal pattern 106 in the form of a cone extending from the nozzle 100 to define a distribution angle 107 of the pattern 106. The distribution angle 107 is preferably inclusively between 120 and 160 degrees, and more preferably is approximately 140 degrees. The distribution angle 107 can be varied with changes to the shape of the impact surface 160. It is believed that the distribution angle of the preferred environment provides coverage without excessive misting. Additional configurations of the impact surface can provide sufficient turbulence to promote distribution of the fire-fighting fluid over a desired coverage area without excessive misting. In the preferred embodiment illustrated in FIG. 6, the dispersal pattern 106 includes an excluded area 108 that the spray extending from the nozzle 100, is substantially shielded from and does not reach directly, and is substantially omitted from to define a conical "hole" in the dispersal pattern 106 extending from the external side of the deflector 146. The excluded area 108 is preferably provided with fire-fighting fluid that is initially delivered to the various surfaces S located adjacent to the nozzle 100 that received a portion of the spray provided by the nozzle, or that is delivered to the excluded area 108 by another nozzle 100 disposed to cover the excluded area, as illustrated in FIG. 6.

The nozzle providing the dispersal pattern is preferably disposed to provide the spray in directions that maximizes fire protection. Referring to FIGS. 5-6, a preferred installation is a fire protection system 200 providing fire protection to a duct system 210 where the nozzle 100 is disposed so that the dispersal pattern 106 extends along the length of a portion of the duct 210. Preferably, multiple nozzles 100 are provided in the duct 210 to provide effective fire protection and, if necessary, to overlap dispersal patterns 106 as illustrated in FIG. 6. The nozzles 100 within a duct installation can be mounted to the walls 212 of the duct 210 with a mounting block 214 that secures the position of the nozzle 100 on the duct wall 212, and that provides an external connection 216 coupled to the nozzle 100 that is connectable to a fluid-supply line 220 extending from a fluid-supply piping system 230. Preferably, the fluid supply piping system 230 is provided fire-fighting fluid from a fluid source 240 that is controlled by a valve 250. The fire protection system 200 of FIG. 5 also has a fire detection device (not shown in FIG. 5) and a controller 260 that receives information from the fire detection device and that controls the operation of the valve 250. In the preferred installation, the nozzle 100 can include a plug (not shown) that is anchored to the nozzle body at one end and inserted in part into the exit port 172 at the other end of the plug. The plug protects the interior of the nozzle body 170 from the corrosive environment surrounding the nozzle. Preferably, the plug is ejected or removed when the nozzle is activated.

As known in the art, the corrosive environment can be a highly corrosive environment and/or an extremely corrosive environment as described in fire protection standards, such as the FM Approvals LLC standard entitled "Approval Standard for Automatic and Open Water-Spray Nozzle for Installation in Permanently Piped Systems," Class Number 2021, 2025, February 2010 (incorporated herein by reference) at section 1.9 where it describes an extremely corrosive environment to include flue gas desulphurization systems, metal acid pickling ducts, chemical industry exhaust systems, etc. and states that extremely corrosive environments encountered are typically sulfuric, hydrochloric, nitric, or hydrofluoric acids. The corrosive environment can be a highly corrosive environment or an extremely corrosive environment found inside of a ductwork system and can include any or all of the following characteristics: temperatures ranging from approximately 20 degrees Celsius to over 100 degrees Celsius; acids such as HCl, HF, $H_2SO_4$, $HNO_3$; pH values of less than 2; gases such as $SO_2$, $SO_3$, $CO_2$, $NO_x$, $Cl_2$, and $F_2$; abrasive particles composed of Cu, Fe, Pb, Zn, As, Sb, Ca, Hg, and Ni, possibly present as oxides or salts; condensation or water droplets; cycles between wet and dry environments; and velocities of over 40 miles/hour. Such corrosive environments are described in U.S. Patent Publication Nos. 2008/0308285 and 2012/0132446, incorporated herein in their entireties.

Components of the nozzle can be made of and include materials suitable for a corrosive environment, to protect the components of the nozzle from corrosion, and to maintain the functionality of the nozzle. Nozzle components (e.g., the nozzle body 170, support member 180, and diffuser 120) can be made of materials that provide resistance to corrosion in such corrosive environments, such as one or more of the following alloys: stainless steel alloys, SS 316 (UNS S31600), high nickel alloys, C22 (UNS 06022), C276 (UNS N10276), C2000 (UNS N06200), G30, and 1686. Such corrosion-resistant materials are described in U.S. Patent Publication Nos. 2008/0308285 and 2012/0132446, incorporated herein in their entireties. The nozzle of the preferred embodiment is made of 316 stainless steel.

The nozzle 100 is preferably covered with a coating 110 to further protect the nozzle components from corrosion. In the preferred embodiment of FIG. 2, the coating 110 covers all exposed surfaces of the nozzle except where threading is provided on the exterior of the nozzle body 170 for engagement with the external connection 216. The coating can be one or more of the following polymers: polytetrafluoroethylene (PTFE), ethylene-chlorotrifluoroethylene (ECTFE, Halar), ethylene-tetrafluoroethylene (ETFE), polyvinylidene fluoride (PVDF, Kynar), perfluoralkoxy (PFA), and fluorinated ethylene propylene (FEP). Such coating materials are described in U.S. Patent Publication Nos. 2008/0308285 and 2012/0132446, incorporated herein in their entireties. The coating of the preferred embodiment is Halar.

Figure 7:
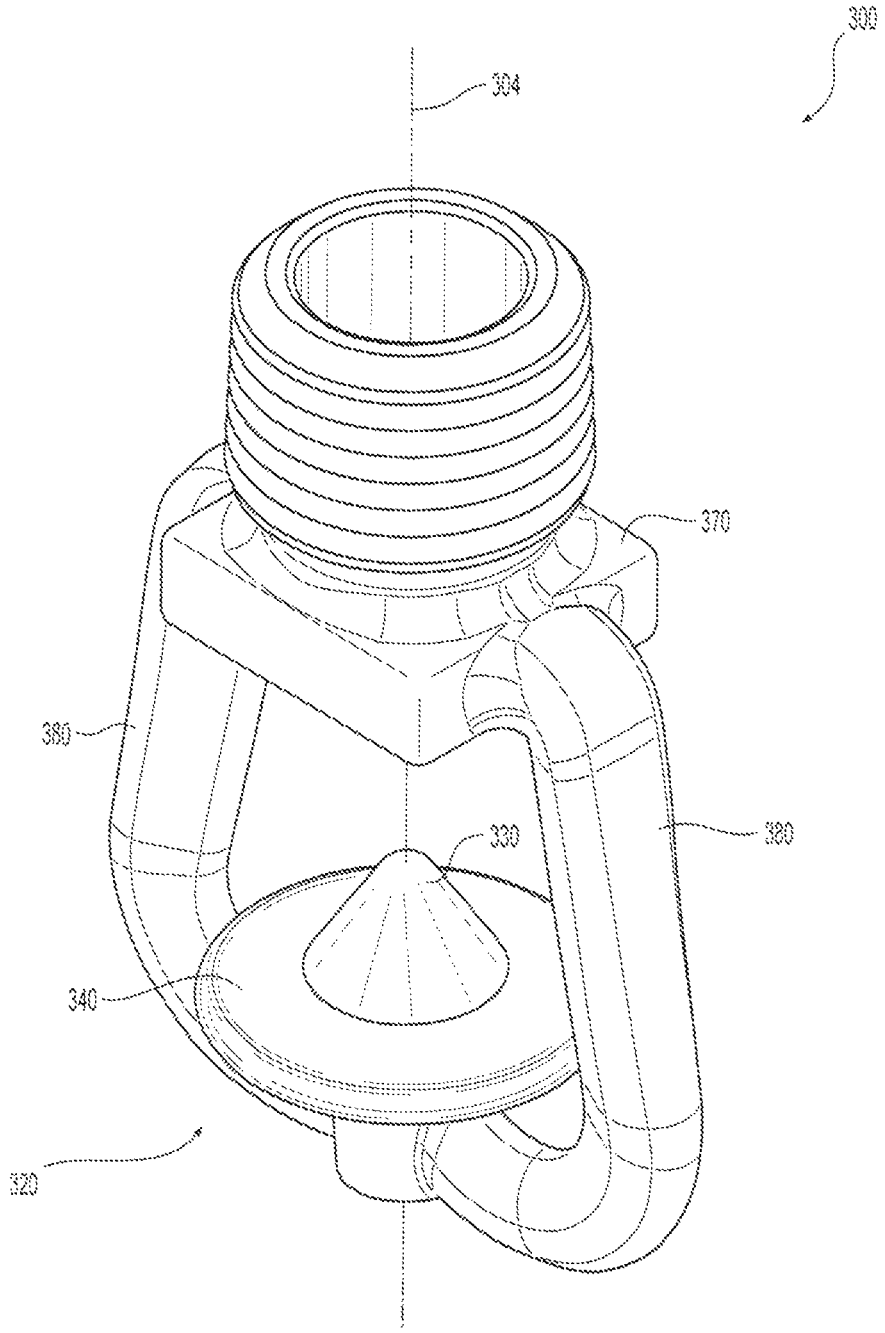
FIG. 7 is an isometric view of an uncoated nozzle preform corresponding to the coated nozzle of FIG. 1.

The exterior dimensions of the nozzle components (the nozzle body 170, support member 180, and diffuser 120) are suitable to accommodate the dimensional changes that result from the application of the coating 110 to the exterior surfaces of the nozzle components. During manufacture, the nozzle components are formed to provide an uncoated nozzle preform 300 that has exterior dimensions that are less than the exterior dimensions of the finished coated nozzle 100 of FIG. 1. The preferred nozzle preform 300 is illustrated in FIG. 7, which is the same nozzle of FIG. 1 but without the coating 110 and with identical features labeled with reference numerals that correspond to those described above and shown in FIG. 1. In alternative embodiments, the nozzle preform 300 can have dimensions or surface features that are selected to provide a surface suitable for supporting and adhering to a coating while providing a desired shape or desired dimensions to the finished coated nozzle. The preferred nozzle preform 300 provides an impact surface that is imperforated.

The nozzle described herein with the corrosion-resistant coating is believed to inhibit functionally-debilitating corrosion when the nozzle is exposed to a corrosive environment, and to maintain the nozzle and the surfaces of the nozzle in a functionally-capable and serviceable condition, for a desirable period of time. Preferably, the desirable period of time (a protection period) is at least one year within the corrosive environment. Alternatively, the desirable period of time can be sixty days, or a time that is based on the characteristics of the corrosive environment, the degree of fire protection desired, and the amount time required for the nozzle to become functionally debilitated in the corrosive environment. The nozzle can inhibit functionally-debilitating corrosion by maintaining coating integrity so that the coating does not have significant cracks or holes that expose the underlying nozzle components to the corrosive environment. Functionally-debilitating corrosion is also inhibited when the coating remains sufficiently bonded to the underlying nozzle components, without separation between the components and coating, and/or without the formation of bubbles under the coating, initiation of edges of the coating that peel away from the nozzle components, or separation between layers of the coating or between the coating and the underlying nozzle components. A nozzle maintains a functionally-capable condition when, for example, the nozzle remains operational within desired parameters, remains capable of delivering sufficient fluid to provide fire protection, and/or remain capable of providing the desired dispersal pattern.

The corrosion-resistant properties of a coated nozzle can be evaluated under various test methods. A preferred test method is capable of providing data regarding how the nozzle would perform in the anticipated corrosive environment for a desired period of time (e.g., one year). For example, a sample coated nozzle can be tested by exposing the nozzle to a representative corrosive environment for a representative period of time and then evaluating the tested nozzle for evidence of corrosion that would provide insight as to how the tested nozzle would perform in the anticipated corrosive environment for the desired period of time. The representative corrosive environment can be the anticipated corrosive environment or a simulation of that environment. The representative period of time can be the desired time period or a shorter period that represents the desired time period. A preferred representative corrosive environment provides all or most of the corrosive characteristics of the anticipated corrosive environment, and a preferred exposure time is a desired period of time of one year or, if not feasible, a shorter time that can represent that desired period of time. For example, a short time can be used if the corrosive characteristics of the representative corrosive environment are made harsher to increase a rate of corrosion. In another example, a shorter period of time can be used in conjunction with a harsher pass/fail criteria where, for example, any corrosion constitutes a failure even when the corrosion is not significant to inhibit performance of the nozzle. Others have recommended test methods that use minimally corrosive environments, such as immersion in water, and periods of time that are 1-2 months in length. For example, FM Approvals LLC Global has described a test method in which a coated test sample is scratched to damage the coating and then exposed to a water environment for two months with a requirement that the test sample exhibit absolutely no cracking, peeling, or other degradation of the coating. The FM Approvals LLC test method is described at section 4.8 of the FM Approvals LLC standard entitled "Approval Standard for Automatic and Open Water-Spray Nozzle for Installation in Permanently Piped Systems," Class Number 2021, 2025, February 2010 (incorporated herein by reference).

Figure 8:
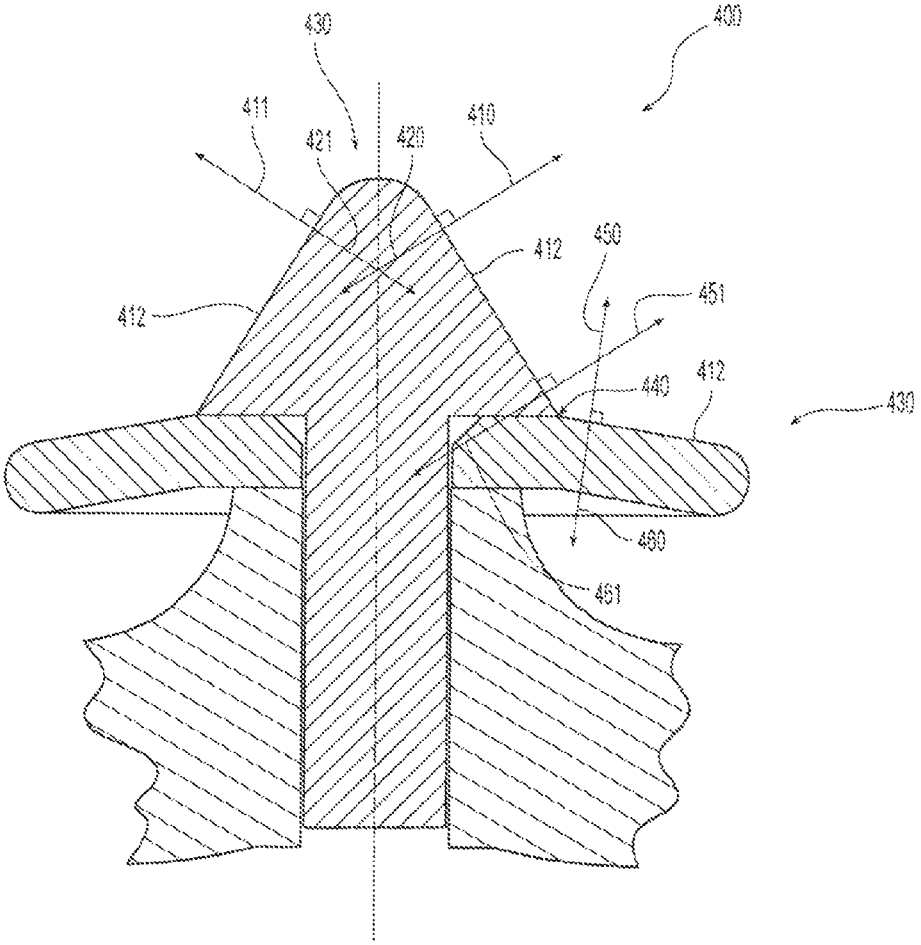
FIG. 8 is an expanded cross-sectional view of an uncoated portion of the nozzle of FIG. 2.

It is believed that the corrosion resistance described above is in part achieved by controlling the configuration of the corners presented on the exterior surfaces of the nozzle preform. In particular, the design of exterior corners (which includes projections and edges) appears to be significant; in contrast, the design of interior corners appears to be less significant. Exterior and interior corners can be defined by surface normals extending from the surfaces forming the corners. Referring to the preform 400 of FIG. 8, a surface normal 410 is a vector extending away from a surface 412 in a direction that is perpendicular to the surface at a given point on the surface. The surface normal 410 can also define an oppositely-directed vector 420 that extends into the surface 412 from the same given point upon which the surface normal originates. Exterior corners 430 are formed by the intersection of two adjoining surfaces 412 have surface normals 410, 411 that do not intersect but have oppositely-directed vectors 420, 421 that do intersect beneath the surfaces 412. Interior corners 440 have the opposite arrangement, with the intersection of two surfaces 412 that have surface normals 450, 451 that do intersect but have oppositely-directed vectors 460, 461 that do not intersect beneath the surfaces 412. In the preferred embodiment, it is believed that improved corrosion resistance is in part facilitated by having all exterior corners of the nozzle preform rounded or obtusely angled so as to not present sharp exterior corners on the exterior surfaces of the nozzle. It is preferable to avoid the use of exterior corners that present right angles (or angles less than 90 degrees) between the surfaces defining the corner, and to avoid the use of an exterior corner having a curvature of less than 1 mm radius (or having a shape that is equivalent to a curvature of 1 mm or less, such as a corner formed by one or more chamfers).

It is believed that the elimination of sharp exterior corners presents a nozzle preform surface topography that is amenable to the application and adherence of the coating at an appropriate thickness and consistency to improve corrosion resistance on the exterior surfaces of the nozzle exposed to the corrosive environment. It is also believed that a topography lacking sharp corners facilitates the application of the coating at a thickness level sufficient to provide corrosion resistance for a commercially viable period of time. A preferred coating thickness is one that is sufficient to protect the nozzle from corrosion while maintaining the desired surface features that provides a suitable dispersal pattern. The coating thickness can be varied depending on the topography presented and the characteristics of the coating. Others have proposed a coating thickness of 0.020-0.030 inches, such as described at section 4.7 of the FM Approvals LLC standard entitled "Approval Standard for Automatic and Open Water-Spray Nozzle for Installation in Permanently Piped Systems," Class Number 2021, 2025, February 2010 (incorporated herein by reference). It is also believed that the interior corners of the nozzle preform surfaces need not be rounded in the same manner as the exterior corners to support the coating and provide sufficient corrosion resistance to the nozzle.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A nozzle for delivering a fire-fighting fluid to a corrosive environment, the nozzle comprising:

a nozzle body defining a central axis and an exit port;

a support member extending from the nozzle body;

a diffuser disposed on the support member about the central axis to face the exit port, the diffuser having a splitter portion and a deflector portion that together define an imperforated impact surface disposed to receive the fire-fighting fluid exiting the exit port, the splitter portion having a first end with an apex facing the exit port and an opposing second end with a base defining an outer diameter of the splitter, the deflector portion having a central portion disposed orthogonally to the central axis and surrounded by a peripheral portion disposed at an angle relative to the central portion, the peripheral portion having a peripheral edge defining an outer diameter of the deflector, the impact surface extending from the apex to the peripheral edge; and a coating disposed to cover at least the nozzle body, the support member, and the diffuser to inhibit functionally-debilitating corrosion of the coated impact surface and maintain the impact surface in a serviceable condition when the nozzle is exposed to the corrosive environment for a period of protection, wherein the splitter outer diameter is one third to two thirds of the deflector outer diameter, and the deflector peripheral edge is rounded in it direction generally parallel to the central axis, wherein the period of protection for disposing the nozzle in the corrosive environment is at least three months, wherein the coating comprises at least one of a coating selected from the group consisting of polytetrafluoroethylene (PTFE), ethylene-chlorotrifluoroethylene (ECTFE), ethylene-tetrafluoroethylene (ETFE), polyvinylidene fluoride (PVDF), perfluoralkoxy (PFA), and fluorinated ethylene propylene (FEP), wherein the corrosive environment includes one or more of: (a) any or all of the following: acids, such as HCI, HF, $H_2SO_4$, $HNO_3$; pH values of less than 2; gases, such as $SO_2$, $SO_3$, $CO_2$, $NO_x$, $Cl_2$, and $F_2$; and abrasive particles comprising at least one of Cu, Fe, Pb, Zn, As, Sb, Ca, Hg, and Ni; and (b) an extremely corrosive environment including at least one of a flue gas desulphurization system, metal acid pickling duct, chemical industry exhaust system, and the extremely corrosive environment includes at least one of sulfuric, hydrochloric, nitric, or hydrofluoric acids.

2. The nozzle of claim 1, wherein the rounded peripheral edge has a radius of at least 1 mm.

3. The nozzle of claim 2, wherein the rounded peripheral edge has a radius of approximately 2 mm.

4. The nozzle of claim 1, wherein the splitter outer diameter is approximately 50% of the deflector outer diameter.

5. The nozzle of claim 1, wherein the splitter defines a splitter height between the first end with the apex and the second end with the base, the splitter height being 0.43 to 1 times the splitter base outer diameter.

6. The nozzle of claim 1, wherein the angle of the deflector peripheral portion is approximately 10-20 degrees.

7. The nozzle of claim 1, wherein the splitter defines a cone angle of the splitter extending from the apex towards the base, the cone angle being 60-70 degrees.

8. The nozzle of claim 1, wherein the splitter further comprises a transition surface extending between the apex and the base, the transition surface and the deflector peripheral portion defining an internal angle between the splitter and the deflector, the internal angle being 130-145 degrees.

9. The nozzle of claim 1, wherein the apex is rounded in a direction generally orthogonal to the central axis, the rounded apex having a radius of at least 1 mm.

10. The nozzle of claim 1, wherein the impact surface defines a dispersal pattern of the fire-fighting fluid when the fluid is distributed about the central axis, a dispersal pattern defining a distribution angle of 120-160 degrees.

11. A nozzle for delivering a fire-fighting fluid to a corrosive environment, the nozzle comprising:

a nozzle body defining a central axis and an exit port;

a support member extending from the nozzle body;

a coating disposed to cover the nozzle to inhibit functionally-debilitating corrosion of a coated impact surface and maintain the impact surface in a serviceable condition when the nozzle is exposed to the corrosive environment for a period of protection; and in diffuser disposed on the support member about the central axis to face the exit port to receive the fire-fighting fluid exiting the exit port, the diffuser having a splitter and a deflector that each have portions that together define an imperforated impact surface, the splitter having a transition surface disposed at an angle relative to the deflector to define an internal angle of 130-145 degrees between the splitter and the deflector, wherein a portion of the splitter defining the impact surface and a portion of the deflector defining the impact surface each having exterior corners, all of the exterior corners defining of the impact surface having at least one non-sharp edge, wherein the period of protection for disposing the nozzle in the corrosive environment is at least three months, wherein the coating comprises at least one of a coating selected from the group consisting of polytetrafluoroethylene (PTFE), ethylene-chlorotrifluoroethylene (ECTFE), ethylene-tetrafluoroethylene (ETFE), polyvinylidene fluoride (PVDF), perfluoralkoxy (PFA), and fluorinated ethylene propylene (FEP), wherein the corrosive environment includes one or more of: (a) any or all of the following: acids, such as HCl, HF, $H_2SO_4$, $HNO_3$; pH values of less than 2; gases, such as $SO_2$, $SO_3$, $CO_2$, $NO_x$, $Cl_2$, and $F_2$; and abrasive particles comprising at least one of Cu, Fe, Pb, Zn, As, Sb, Ca, Hg, and Ni; and (b) an extremely corrosive environment including at least one of a flue gas desulphurization system, metal acid pickling duct, chemical industry exhaust system, and the extremely corrosive environment includes at least one of sulfuric, hydrochloric, nitric, or hydrofluoric acids.

12. The nozzle of claim 11, wherein the splitter has a base defining an outer diameter of the splitter, the deflector has a peripheral edge defining an outer diameter of the deflector, and the splitter base outer diameter is one third to two thirds of the deflector outer diameter.

13. The nozzle of claim 12, wherein the splitter base outer diameter is approximately 50% of the deflector outer diameter.

14. The nozzle of claim 11, wherein the splitter defines a splitter height extending along the central axis and a splitter base abutting the deflector, the splitter base defining a splitter base outer diameter, the splitter height, being 0.43 to 1 times the splitter base outer diameter.

15. The nozzle of claim 11, wherein a splitter transition surface converges to define an apex of the splitter, the splitter transition surface defining a cone angle of the splitter extending from the apex, the cone angle being 60-70 degrees.

16. The nozzle of claim 11, wherein the deflector has a peripheral edge that is rounded in a direction generally parallel to the central axis, the rounded peripheral edge having a radius of at least 1 mm.

17. The nozzle of claim 11, wherein the apex is rounded in a direction generally orthogonal to the central axis, the rounded apex having a radius of at least 1 mm.

18. The nozzle of claim 11, wherein the impact surface defines a dispersal pattern of the fire-fighting fluid when the fluid is distributed about the central axis, the dispersal pattern defining a distribution angle of 120-160 degrees.

19. The nozzle of claim 11, wherein the nozzle is activated by the delivery of the fire-fidgeting fluid from a fire protection system coupled to the nozzle, the fire protection system having a valve that controls the delivery of the fluid to the nozzle and a control system controlling an operation of the valve.

* * * * *